United States Patent [19]

Gaster et al.

[11] Patent Number: 4,773,798

[45] Date of Patent: Sep. 27, 1988

[54] PORTABLE WASHER CUTTERS

[75] Inventors: Ivan Gaster, Grafton, Ohio; Norrie S. Longo, Strathem, N.H.

[73] Assignee: The General Industries Company, Elyria, Ohio

[21] Appl. No.: 82,194

[22] Filed: Aug. 5, 1987

[51] Int. Cl.[4] ..... B26D 3/00

[52] U.S. Cl. ..... 408/102; 30/310; 83/456; 83/464; 83/490; 83/508.2

[58] Field of Search ..... 30/300, 310, 360; 83/456, 464, 490, 508.2, 594, 596; 408/102, 189

[56] References Cited

U.S. PATENT DOCUMENTS 4,060,893 12/1977 Matsuura ..... 30/310

4,173,913 11/1979 Nicholson ..... 30/310 X 4,548,118 10/1985 Brosch ..... 30/310 X 4,581,824 4/1986 Wilkins et al. ..... 30/310

*Primary Examiner*—Gil Weidenfeld

*Assistant Examiner*—Steven C. Bishop

*Attorney, Agent, or Firm*—J. Helen Slough

[57] ABSTRACT

The portable washer cutter of this invention comprises a pair of enclosures adapted to be interconnected and operative to rotate to progressively close the two enclosures together. A cutting knife edge secured in one enclosure progressively engages with each rotation a flat washer blank supported in the other enclosure to produce a desired central cut-out from the washer blank.

27 Claims, 7 Drawing Sheets

PORTABLE WASHER CUTTERS

BACKGROUND OF THE INVENTION

This invention relates to portable cutters for cutting sealing washers of the type used for sealing spliced telecommunication cables together.

In the telecommunications field, cables are often spliced together at various points and are enclosed within a sealed closure to protect the spliced connections from moisture, dirt, and other environmental contaminants. The typical cable closure is cylindrical in shape and secured with flat sealing washers having circular openings through which the telecommunication cables are inserted and passed into the closure. In practice, the cables are of various diameters which require matching circular openings in the sealing washers to center the cables within the closure as well as seal the ends of the closure. Accordingly, the flat sealing washers are provided with an outside diameter adapted to interconnect and seal the outer periphery of the closure and an interior cut-out diameter essentially equal to the diameter of the spliced telecommunications cable which is inserted through the sealing washer and plates of the closure.

Prior to the present invention, U.S. patents disclosed splice cutters for such cable, for example U.S. Pat. No. 2,788,385; also rotary cutters for cutting a sheet into circular form or cutting holes of various sizes in sheet material were disclosed in U.S. Pat. Nos. 4,060,893, 4,426,781, 3,621,574, 4,548,118, 4,173,913. In U.S. Pat. No. 1,299,688 a washer cutter is shown having a C-shaped standard consisting of a flat base and an upper arm spaced therefrom by a substantially vertical stanchion, the upper arm being parallel with the base and having a spindle disposed therethrough, a handle is carried by the upper end of the spindle and a transverse bar is carried by a downwardly extending end of the spindle, the bar being adjustable longitudinally and carrying a pair of cutters disposed at an angle to the face of a table placed on the base upon which material is seated from which washers are cut. In U.S. Pat. No. 3,994,194 a similar C-shaped standard is shown for making circular cuts in sheet material which has substantially planar base to support the material, a lever or knob being mounted on the upper end of a shaft for rotating the same, a cutter assembly being carried on the lower end of the shaft which has an elongated member carrying the triangular cutter which can be disposed at a plurality of radial positions from the vertical axis of the shaft.

Similarly U.S. Pat. No. 4,581,824 discloses a C-shaped standard carrying a rotatable shaft, a transverse bar which is a blade carrying member which slides through an opening in the shaft in a radial direction, a base platform or table opposite to one end of the shaft for supporting a sealing washer blank, the blade adapted to be placed in a desired position to cut a central opening in the blank.

The structure of U.S. Pat. No. 4,581,824 involves the use of an upright standard which is awkward to handle at the cable closure location where the repair person ascertains the diameter of the cable and where the sealing washer is cut to provide an opening of proper size for accomodating of the cable end plates.

It now has been found that a hand held portable washer cutter can be easily and efficiently operated in the field to cut flat washer blanks for use in sealing closures for enclosing spliced connections in multiconductor or telecommunication cables. The portable washer cutter of this invention comprises a pair of saucer shaped enclosures adapted to interconnect together and operative to cut a central cut-out in a flat washer blank supported within the cutter enclosures. One enclosure supports the flat washer blank while the other enclosure contains a depending cutting means adapted to progressively cut into the washer blank by rotating the upper enclosure relative to the lower enclosure. The one said enclosure preferably is fitted with a center post adapted to engage a socket centered and secured within the other said enclosure whereby the said enclosures can be progressively tightened together with each clockwise rotation of the upper enclosure relative to the lower enclosure. As the enclosures are tightened together, the cutting means cuts further into the flat washer blank until a center hole or cut-out is cut through the flat washer blank. The outer surfaces of the enclosures can be specifically formed with peripheral indentations to provide finger gripping means to facilitate gripping each enclosure while rotating the same in accordance with this invention. The hand held portable washer cutter is simple in construction, easy to manufacture, and can be expediently and efficiently used in the field to accurately cut central cut-outs, from flat washer blanks. These and other advantages of this invention will become more apparent from the drawings and detailed description of this invention.

SUMMARY OF THE INVENTION

Briefly, the portable washer cutter of this invention, comprises an interconnecting pair of enclosures operative together to cut a circular cut-out from a flat washer blank. The interconnection between the enclosures provides for progressive cutting of a cut-out by rotating the enclosures relative to each other where a depending cutting means secured within one of the enclosures progressively cuts into the flat washer blank with each rotation.

IN THE FIGURES

DETAILED DESCRIPTION OF THE INVENTION

Figure 1:
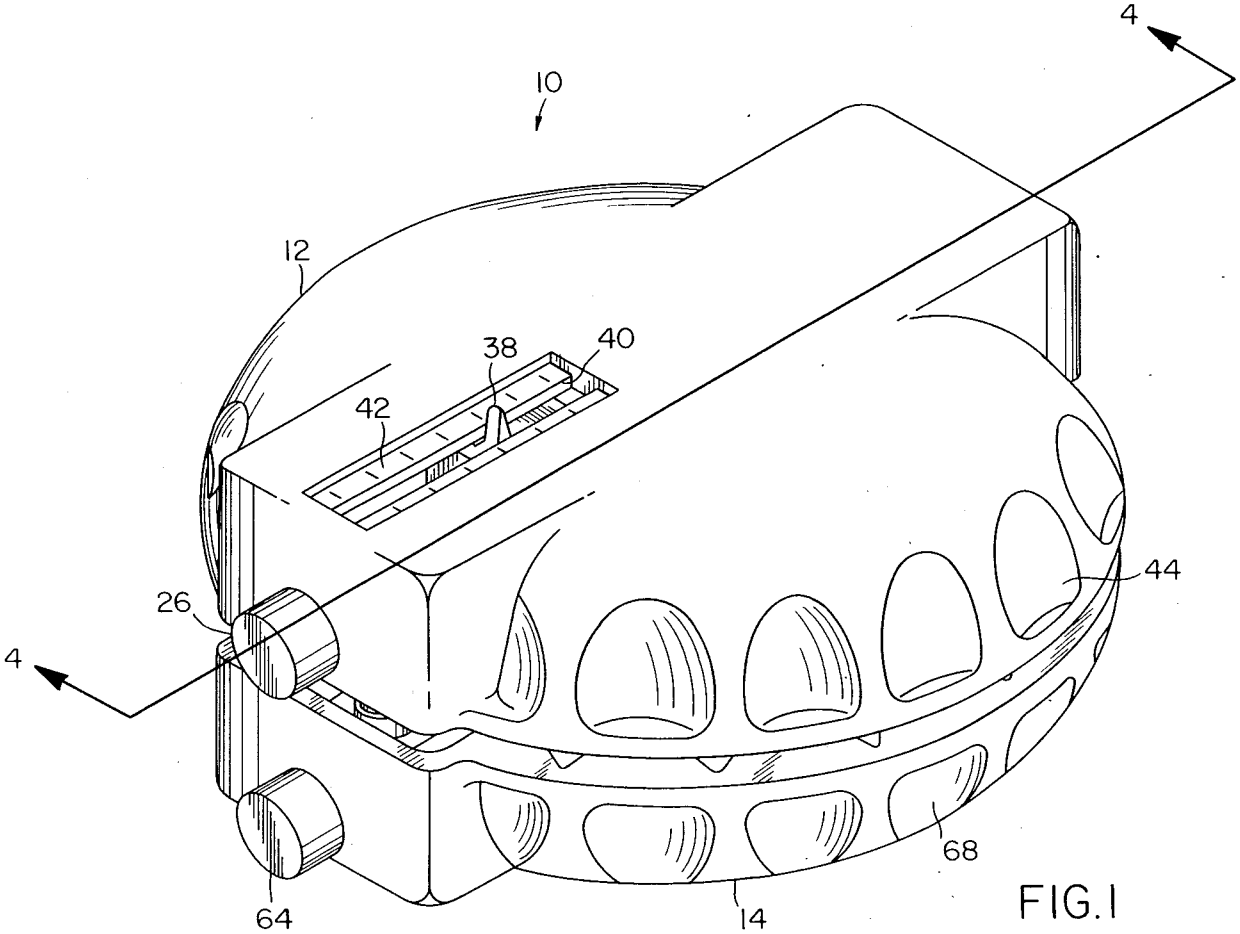
FIG. 1 is a top isometric view of the portable washer cutter of this invention.
Figure 7:
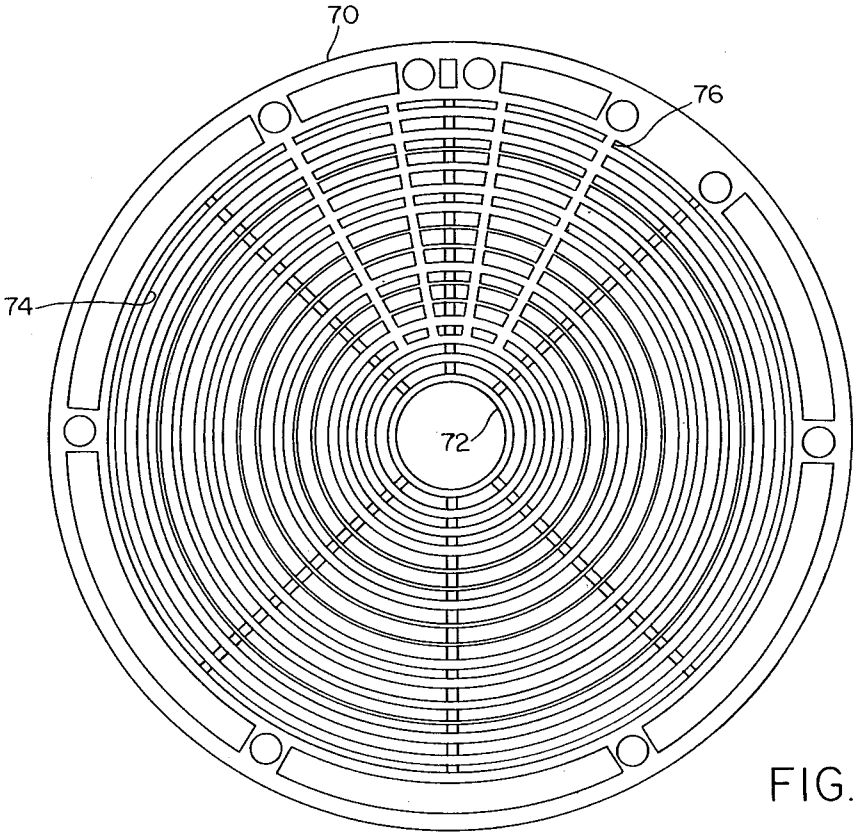
FIG. 7 is a plan view of a flat washer blank which is adapted to be cut by the washer cutter assembly of FIGS. 1 to 6.

Referring now to the drawing wherein like reference characters represent like parts, the portable washer cutter 10 of this invention as shown in FIG. 1 comprises saucer shaped upper and lower enclosure elements 12 and 14 which are adapted to be operatively interconnected and fitted together to cut flat washer blanks of the type shown in FIG. 7.

Figure 8B:
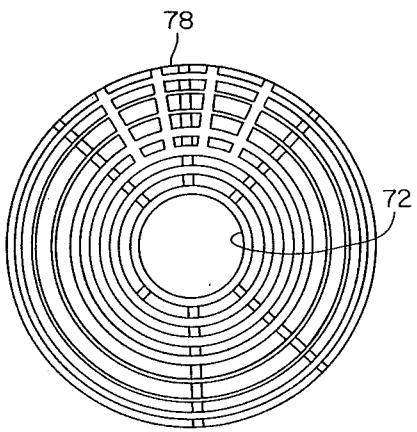
FIGS. 8A and 8B are planar views of the flat washer of FIG. 7 after cutting.
Figure 8A:
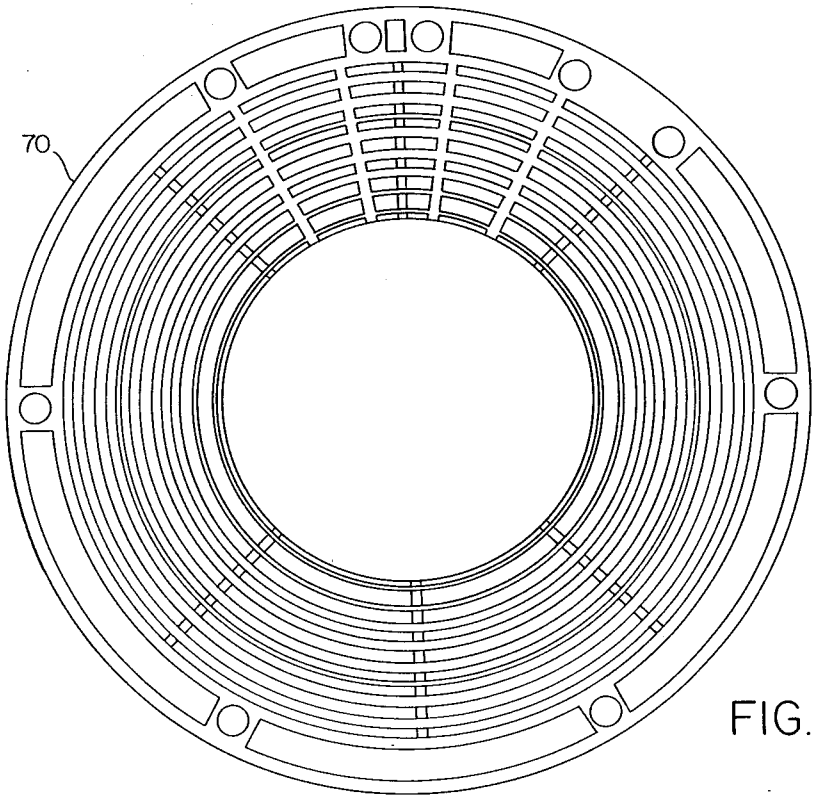

Referring first to FIG. 7, a flat disc type sealing washer blank 70 molded from plastic or other similar rigid material is shown which is typical of sealing washers used in the telecommunications industry. The washer blank 70 comprises a central opening 72 surrounded with a series of concentric circumferential grooves 74 in conjunction with several radial ribs transversing the concentric grooves 74. The grooves 74 extend only partly through the thickness of the washer blank 70 and the reverse side (not shown) of the blank 70 remains a solid surface. The central opening 72 is useful for centering the washer blank 70 within the portable washer cutter 10 while the circumferential grooves 74 are useful to facilitate cutting interior holes into the washer blank 70. In this regard, FIG. 8A illustrates a washer blank 70 with a central circular cut-out 78 removed from the washer blank 70 which cut-out portion is further shown in FIG. 8B.

Figure 2:
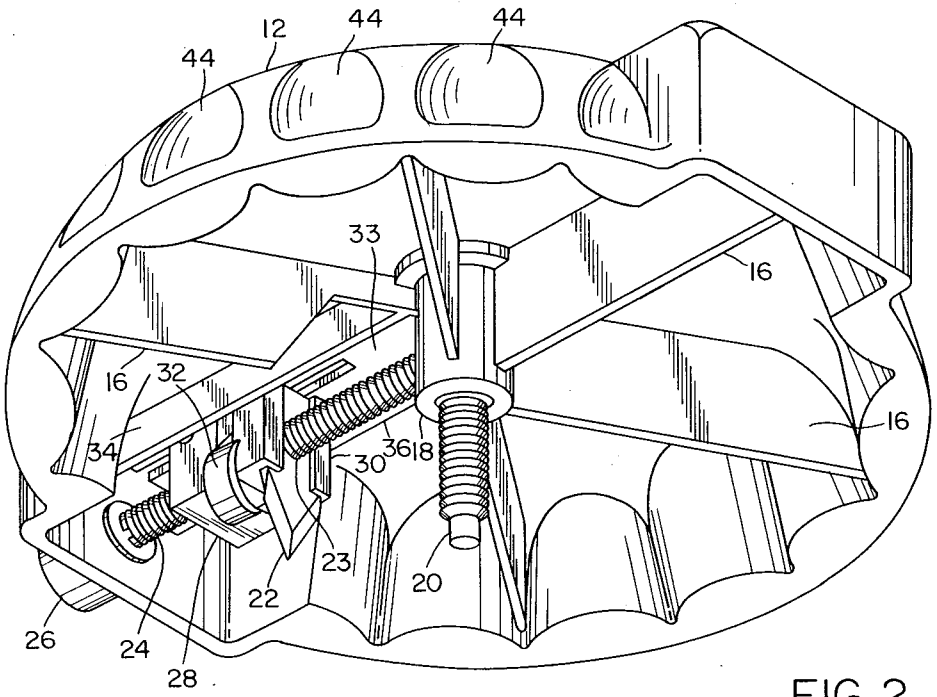
FIG. 2 is a view looking up into the top section or upper enclosure of the cutter assembly of FIG. 1.

Referring again to the portable washer cutter 10 and particularly to FIG. 2 wherein an underside view of the interior cavity of the upper enclosure 12 is shown, the inside cavity of the upper enclosure 12 contains a plurality of radially directed bracing members 16 therein dividing the same into sectors and extending from the outer periphery of the cavity and terminating inwardly at the geometric center with a center post or core member 18 affording secure seating of a threaded rod 20 therein which depends therefrom when the enclosure 12 is placed over the lower enclosure 14 and is adapted to engage an adapter means 52 centrally located in the lower enclosure 14.

Figure 5:
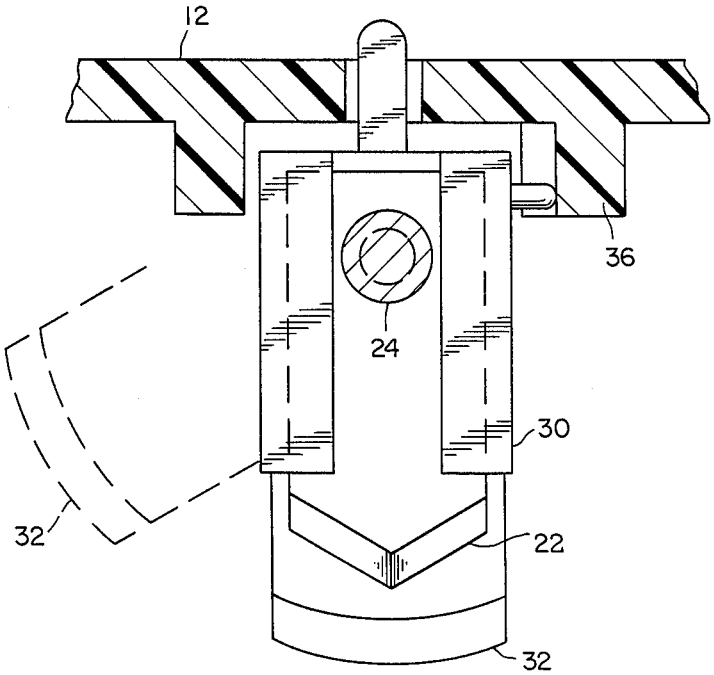
FIG. 5 is an enlarged partial sectional view of the cutter blade assembly taken along line 5—5 in FIG. 4.
Figure 6:
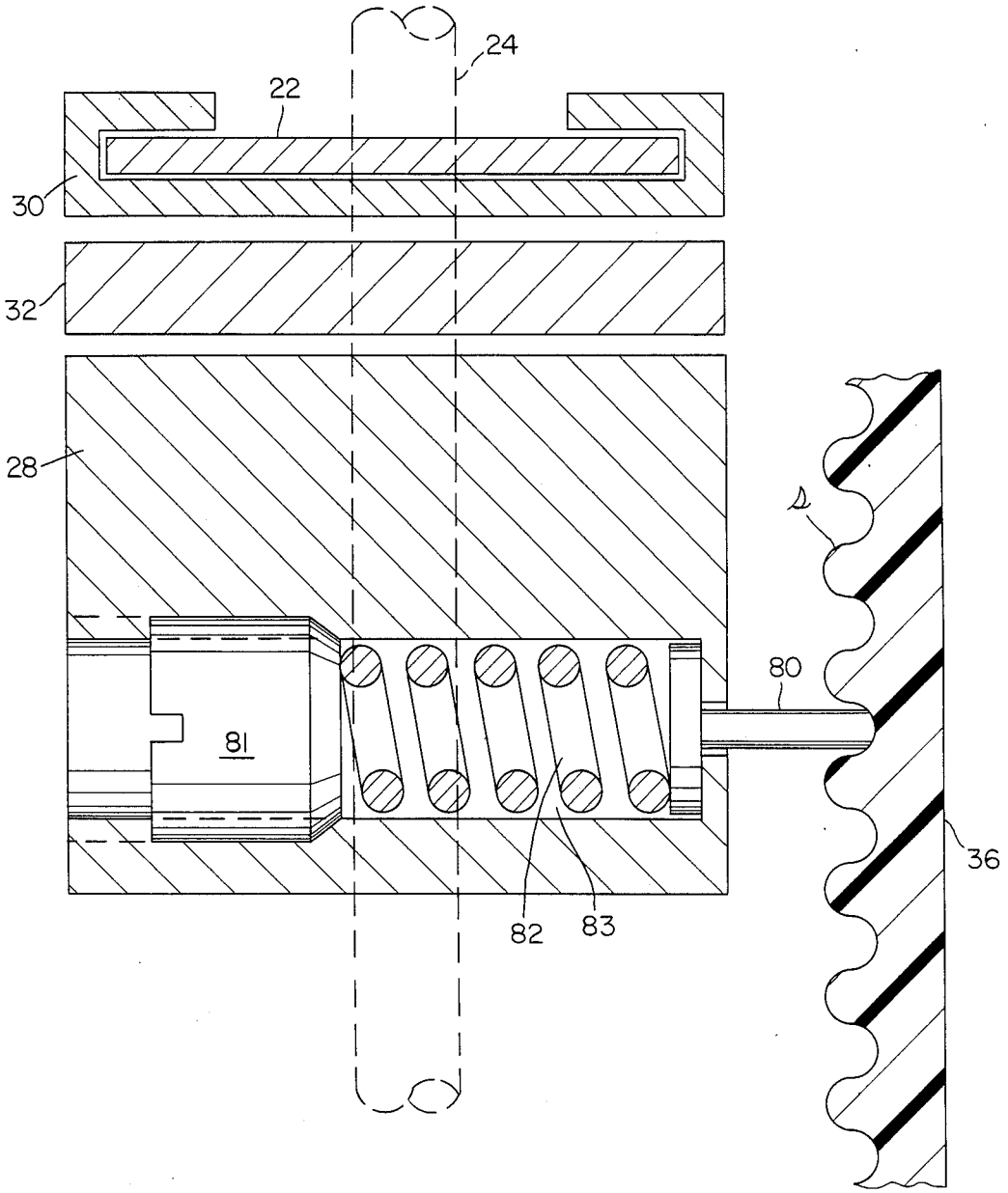
FIG. 6 is a sectional view taken on the line 6—6 of FIG. 4.

The upper enclosure further carries the cutting means for cutting a sealing blank. Said cutting means comprises a depending blade having a knife edge 22 and said knife is provided with an aperture 23 through which a longitudinally disposed and radially directed threaded member 24 is disposed; said member is adapted to be supported at its inner end within a fixed lateral opening 24' within the center post or bearing and at its outermost end in a knob 26 wherefor the member 24 carrying the blade is adapted to be rotated and the knife edge carried thereby radially adjusted. The knob 26 is disposed on an outer end of the rotatably threaded member 24 and is disposed on the exterior side of the upper enclosure to provide exterior hand operable means for rotating the radially rotational member 24 to adjust the cutting knife edge 22. The blade cutting means preferably is mounted within an interiorly threaded nut 28 and an interiorly threaded block member 30 for securing the knife edge 22 in secure downwardly extending vertical position. The nut 28 and blade holding member 30 are operative to advance or retreat as a unit on the radial threaded member 24 which as shown is disposed longitudinally of and above a U-shaped channel 33 in which the nut 28 and knife holding member moves. (See FIG. 2.) The knife preferably is provided with a rotatable knife edge guard 32 tightly engaged between the nut 28 and the holding member 30. Although not necessary, the knife guard 32 is highly desirable for safety reasons to protect the cutting knife edge 22 while not in use, as best viewed in FIG. 5. The nut 28 and holding member 30 preferably comprise a square shaped unit adapted to advance and retreat within, as stated, the radially directed channel 33 defined by wall members 34 and 36 secured within the interior cavity to the upper enclosure 12. One of said wall members and as shown in FIG. 6 the wall member 36 is provided with evenly spaced serrations "s" in the upper edge thereof as shown in which a spring biased plunger 80 is adapted to be seated sequentially upon movement of the blade carrying mounting. A set screw 81 maintains the compression on spring 82 in place in the opening 83 in the nut 28. Accordingly, the cutting knife 22 can be adjusted radially and controlled to cut the desired diameter cut-out 78 by rotating the threaded member 24 to radially advance or retract the nut 28 and holding member 30 within the radial channel, as best viewed in FIGS. 2 and 4.

Figure 4:
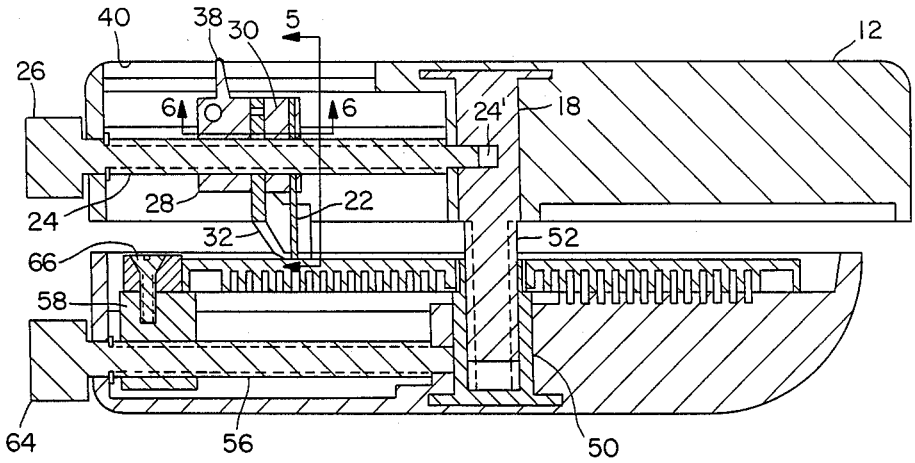
FIG. 4 is a sectional view taken from the line 4—4 of FIG. 1.

The cutting means 22 further as shown in FIG. 4 includes a stylus marker 38 secured to either the nut 28 or the holding member 30, the stylus 38 extending upwardly and outwardly through a radial slot 40 provided in the upper wall of the upper enclosure 12, as best viewed in FIG. 1. The upwardly extending stylus 38 is readily measured against a stationary scale 42 molded into the upper surfaces of the upper enclosure 12 or otherwise located laterally adjacent to the radial slot 40. As viewed in FIG. 4, the upwardly extending stylus 38 need not be centered over the knife edge 22 so long as the scale 42 is similarly off-set from the true center of the center member 18 centering the washer blank 70.

Figure 3:
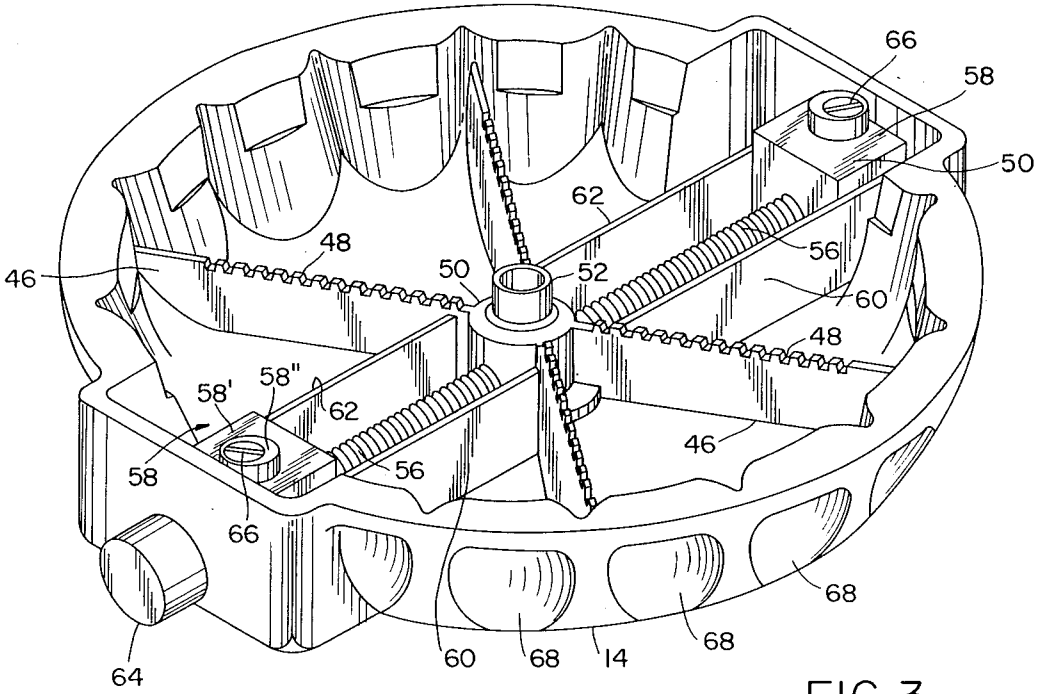
FIG. 3 is a view looking down on the bottom section or lower enclosure of the cutter assembly of FIG. 1.

Referring now to FIG. 3 disclosing an inside view of the lower enclosure 14 looking downwardly into the cavity within the same of the portable washer cutter 10, the lower enclosure 14 contains four radially extending bracing members or ribs 46 secured to the lower enclosure 14. Each radial bracing member 46 is provided with a plurality of circumferentially spaced serrations 48 on the upper edge of the same which serrations are radially spaced and circumferentially aligned and of a size to seat the concentric circular grooves 74 in the flat washer blank 70. The radial bracing members 46 further extend inwardly from the outer peripheral wall of the lower enclosure 14 and are integrally interconnected with central post member 50 having an interior threaded socket or bearing 52 particularly adapted for threaded engagement with the upper threaded rod 20 secured to the upper enclosure 12 previously described. It is readily seen that the socket and threaded rod means can be reversed whereby the upper engaging means would comprise a socket and the lower adapting means a rod means, the combination of upper engaging means and lower adapting means in combination comprising a rotor shaft means generally.

The lower enclosure 14 further contains a pair of independently adjustable peripheral stops 58 comprising an internally threaded block 58' upon which a screw threaded sleeve 58" is rotatably mounted for engaging the outer periphery of the flat washer blank 70 to secure the blank within the lower enclosure and prevent rotational movement of the blank 70 while cutting the cut-out 78. The sleeve 58" is of involute form with a varying wall thickness and acts as a cam to compensate for radial pressures exerted in cutting the washer blank. Each peripheral stop is radially adjustable and rides on a longitudinally disposed threaded bolt 56 supported at its inner end within the lower center post 50, which bolt is provided with a knob 64 disposed on the exterior of the opposite side walls of the enclosure 14. Each threaded bolt means 56 is adapted to be rotated by the rotation of the knurled knob 64 and advances the non-rotatable threaded block or nut 58 advancing inwardly or outwardly within a confining radial channel defined by upwardly extending wall members 60, 62, as best viewed in FIG. 3. Each threaded bolt means 56 extends outwardly through an opening on an opposite side of the peripheral walls of the lower enclosure 14. Accordingly, the peripheral stops can be readily adjusted radially to accomodate various diametric size washer blanks 70 by rotating the exterior knobs 64 to advance or retract the blocks 58. Each block 58, as stated above, further includes a locking screw 66 adapted to be tightened downwardly through the sleeve 58" of the block 58 and against the longitudinally disposed threaded bolt means 56 to securely lock the sleeve 58" in place against the outer periphery of the flat washer blank 70.

The upper enclosure 12 contains a plurality of indents 44 located on the outer peripheral wall of the upper enclosure 12 while the lower enclosure 14 contains similar indents 68 and said upper and lower indents 44 and 68 facilitate hand gripping of the portable washer cutter 10 in use, the fingers and thumb being adapted to grasp the enclosures by gripping the walls in said indents. Hence, it will be apparent that the portable washer cutter 10 of this invention can be easily and efficiently used in the field to cut appropriate size center cut-outs 78 from flat washer blanks 70.

In use, the upper and lower enclosures 12, 14 are separated to locate the washer blank 70 within the lower enclosure 14 by centering the central opening 72 of the blank around the upwardly extending socket means 52 while aligning the circumferential grooves 74 in the washer blank 70 with the series of serrations 48 on the radial bracing members 46 whereby the solid surface side of the washer blank 70 faces upwardly. The peripheral stops are engaged by adjusting the block members 58 inwardly to securely engage the outer circumferential periphery of the washer blank 70 whereupon the locking screws 66 are tightened downwardly to lock the engaging block members 58 in place.

The diameter of the desired cut-out 78 to be cut from the washer blank 70 is determined by the operator and the cutting means or knife edge 22 is set accordingly by adjusting the stylus 38 relative to the preset scale 42.

The upper enclosure 12 is then matched with the lower enclosure 14 by inserting the downwardly depending threaded rod 20 into the internally threaded lower socket or bearing member 52, whereupon the upper enclosure 12 can be rotated clockwise relative to the lower enclosure 14. The upper and lower enclosures 12, 14 can be easily gripped with both hands by utilizing the hand gripping indents 44 on the upper enclosure 12 and indents 68 on the lower enclosure 14. The upper enclosure 12 is rotated in repeating circular cycles to progressively advance the downwardly depending knife edge 22 into a selected concentric groove in the solid surface of a washer blank 70, until the central cut-out 78 is cut free of the washer blank 70. The knife guard 32, which normally is placed with its hood protecting the knife edge 22, is rotated upon contact of the same with the washer upon relative rotation of the upper and lower enclosures with respect to each other to move away from the knife edge of the blade to expose the knife edge 22 in preparation for cutting the central cut-out 78. The blank 70 with an enlarged cut-out interior is useful as a sealing washer for end enclosures on a closure for sealing spliced cables used in the telecommunications field.

To remove the washer blanks, the upper enclosure 12 is rotated in a counter clockwise direction with respect to the lower enclosure 14. In characterizing the pair of enclosures as "upper" and "lower" herein it is not intended that the enclosures necessarily must be kept in such positions in use and/or during rotation thereof since it is obvious that the enclosures could be reversed in their relative positions within the scope of this invention.

Although the drawings and detailed description set forth preferred embodiments of the invention, equivalent structures are contemplated, and the scope of the invention is not limited except by the appended claims.

What we claim is:

1. A portable washer cutter for cutting a circular internal cut-out from a flat washer blank, the washer cutter comprising:

a pair of enclosures adapted to operatively engage together to cut a circular internal cut-out from a flat washer blank adapted to be supported within one of the said enclosures, said first enclosure comprising means for centering the washer blank, said second enclosure having means secured thereto for securing said first enclosure in spaced relation to the said second enclosure for relative rotation therewith;

a radially adjustable cutting means secured to the first enclosure depending therefrom and adapted to be brought in contact with the washer to cut a circular cut-out from the washer blank;

means for rotating the first engaging means interconnected to the second adapting means to progressively move the first enclosure relatively close to the second enclosure bringing the cutting means into intimate contact with said blank wherefor said cutting means may progressively cut a circular center cut-out from the flat washer blank upon continual rotation of the first enclosure with respect to the second enclosure.

2. The portable washer cutter in claim 1 wherein the first enclosure has an interior cavity with cutting means secured thereto and positioned within said interior cavity; and the second enclosure has an interior cavity wherein the securing means is secured to the second enclosure within said interior cavity.

3. The portable washer cutter in claim 2 wherein the interior cavity of the first said enclosure contains supporting structure for supporting the flat washer blank within said cavity.

4. The portable washer cutter in claim 3 wherein the supporting structure contains concentric circumferential serrations for engaging the flat washer blank.

5. The portable washer cutter in claim 2 where the interior cavity of the first said enclosure contains means for locking the exterior periphery of the flat washer blank to secure the washer blank within the interior cavity of the lower enclosure.

6. The portable washer cutter in claim 5 where the locking means comprises radially adjustable peripheral stops.

7. The portable washer cutter in claim 6 where the peripheral stops comprise two diametrically opposed peripheral stops.

8. The portable washer cutter in claim 6 where each peripheral stop comprises a longitudinal threaded member fitted with an interior threaded block carrying means adapted to engage the periphery of the washer blank, each said block being radially adjustable by rotating the longitudinal threaded member to radially adjust the block inwardly or outwardly.

9. The portable washer cutter in claim 8 where each said block rides within a radial channel structure secured to the first said enclosure.

10. The portable washer cutter in claim 8 where each interior threaded block contains a locking screw for locking the block in secure engagement with the longitudinal threaded member.

11. The portable washer cutter in claim 1 where the second engaging means comprises a centered threaded rod, and the first adapting means comprises a centered, interior threaded socket.

12. The portable washer cutter in claim 1 where the second engaging means comprises a centered interior threaded socket and the first adapting means comprises a centered threaded rod.

13. The portable washer cutter in claim 1 where the second engaging means and first adapting means comprises a rotor shaft and socket means.

14. The portable washer cutter in claim 1 where the means for centering the flat washer comprises a centered lower adapting means.

15. The portable washer cutter in claim 14 where the centered first adapting means comprises an interior threaded socket interconnecting with the second engaging means.

16. The portable washer cutter in claim 1 where the radially adjustable cutting means comprises a longitudinally disposed and radially directed threaded member adapted to be rotated to radially adjust the cutting means.

17. The portable washer cutter in claim 16 where the cutting means includes an interior threaded holding member operative to engage the radial directed threaded member, where the holding member contains a knife edge secured thereto for cutting the cut-out in the flat washer blank.

18. The portable washer cutter in claim 17 where the cutting means includes a movable guard for protecting the knife edge.

19. The portable washer cutter in claim 18 wherein the movable guard is moved away from the knife edge upon contact with the washer blank.

20. The portable washer cutter in claim 17 where the holding member rides within a radially directed channel defined by radial wall members secured to the second enclosure.

21. The portable washer cutter in claim 16 where a radius marking means is attached to cutting means to indicate the radius or diameter of the cut-out.

22. The portable washer cutter in claim 20 where the radius marking means comprises an outwardly extending stylus in conjunction with a scale indicator for the radius or diameter of the cut-out.

23. The portable washer cutter in claim 20 where the radius marking means comprises an outwardly extending stylus, and the second enclosure contains a radial slot for receiving the stylus.

24. The portable washer cutter in claim 22 where the scale is located on the outer surface of the second said enclosure adjacent to the radial slot.

25. The portable washer cutter of claim 2 where the exterior surface of the second said enclosure contains a plurality of indentations on the outer peripheral surface of the second enclosure to provide gripping means.

26. The portable washer cutter in claim 2 where the exterior peripheral surface of the first said enclosure contains a plurality of indentations to provide finger gripping means on the first said enclosure.

27. The portable washer cutter in claim 2 where both enclosures contain peripheral indents on the outer surfaces thereof respectively to provide gripping means.

* * * * *